US007281893B2

(12) United States Patent
Pan

(10) Patent No.: US 7,281,893 B2
(45) Date of Patent: Oct. 16, 2007

(54) SUPPORTING FRAME WITH LOCATING FUNCTION

(75) Inventor: Ming-Hui Pan, Hsin Chuang (TW)

(73) Assignee: Asia Vital Components Co., Ltd., Kaohsiung (TW)

( * ) Notice: Subject to any disclaimer, the term of this patent is extended or adjusted under 35 U.S.C. 154(b) by 0 days.

(21) Appl. No.: 10/921,894

(22) Filed: Aug. 20, 2004

(65) Prior Publication Data

US 2005/0271506 A1 Dec. 8, 2005

(30) Foreign Application Priority Data

Jun. 3, 2004 (TW) ..... 93115959 A

(51) Int. Cl.
*F04D 29/60* (2006.01)

(52) U.S. Cl. ..... 415/177; 415/211.2; 415/213.1; 165/80.3; 361/697; 361/704

(58) Field of Classification Search ..... 415/179, 415/177, 178, 213.1, 211.2; 165/80.3; 361/697, 361/704

See application file for complete search history.

(56) References Cited

U.S. PATENT DOCUMENTS 5,603,374 A * 2/1997 Wu ..... 165/80.3
5,677,829 A * 10/1997 Clemens ..... 361/697
6,017,185 A 1/2000 Kuo
6,186,739 B1 * 2/2001 Hsieh ..... 415/213.1
6,427,763 B1 * 8/2002 Matsumoto ..... 165/80.3
6,538,888 B1 * 3/2003 Wei et al. ..... 361/697
6,560,111 B1 * 5/2003 Lo ..... 361/719
6,662,412 B2 * 12/2003 Chuang et al. ..... 24/457
6,712,127 B2 * 3/2004 Lee ..... 165/80.3
6,722,418 B2 * 4/2004 Zhang ..... 165/80.3
6,898,083 B1 * 5/2005 Hornung ..... 361/704
7,156,157 B2 * 1/2007 Liu ..... 165/80.3

* cited by examiner

*Primary Examiner*—Edward K. Look
*Assistant Examiner*—Nathan Wiehe
(74) *Attorney, Agent, or Firm*—Birch, Stewart, Kolasch & Birch, LLP

(57) ABSTRACT

A supporting frame with locating function mainly includes a supporting portion and a plurality of connecting portions. The supporting portion is provided at a central area with a plurality of hollow spaces, and is connected at an upper side to a fan and at a lower side to a radiator. The supporting portion is provided on a rim area with fixing holes, via which fastening elements are extended to connect the supporting portion to the radiator. Each of the connecting portions includes an axially extended connecting hole, in which a locating mechanism is received. The connecting portion is connected at an upper side to the supporting portion, and at a lower side to a main board via screwing and elastic elements of the locating mechanism. With the supporting frame, the fan and the radiator can be quickly assembled to the main board.

5 Claims, 9 Drawing Sheets

SUPPORTING FRAME WITH LOCATING FUNCTION

This Non-provisional application claims priority under 35 U.S.C. §119(a) on Patent Application No(s). 093115959 filed in Taiwan, Republic of China on Jun. 3, 2004, the entire contents of which are hereby incorporated by reference.

FIELD OF THE INVENTION

The present invention relates to a supporting frame with locating function in connection with a central processing unit (CPU), and more particularly to a supporting frame with locating function for locating a fan and a radiator above a CPU to enable good radiating of heat produced by the CPU during operation thereof.

BACKGROUND OF THE INVENTION

FIG. 1 shows a conventional supporting frame 13 mainly including a main body 131 and a plurality of locating mechanisms 132. The main body 131 includes a central area that is in contact with a CPU 14 to transfer heat produced by the CPU 14 during operation thereof to a radiator 12 connected to a top of the main body 131. The main body 131 and the radiator 12 are connected together by means of welding, bonding, or mechanical engagement. The locating mechanism 132 includes a driving element 132*a* and a driven element 132*b*, into which the driving element 132*a* is inserted. When the driving element 132*a* is depressed, it causes a retaining portion 132*c* provided at a lower end of the driven element 132*b* to stretch outward and therefore hook to a main board 15 below the supporting frame 13, so that the supporting frame 13 is assembled to a top of the main board 15. On the other hand, when the driving element 132*a* is returned to the original upper position, it brings the retaining portion 132*c* of the driven element 132*b* to the original closed state. More specifically, the locating mechanism 132 achieves the function of assembling the supporting frame 13 to the main board 15 because the retaining portion 132*c* outward stretches when it enters a receiving hole 151 provided on the main board 15. That is, when the locating mechanism 132 downward extends through the receiving hole 151 provided on the main board 15 in the vicinity of a CPU holder 142, the stretched retaining portion 132*c* enables the main body 131 of the supporting frame 13 to assemble to the main board 15 with the central area of the main body 131 in contact with a CPU 14 located on an operating chip 141.

Please refer to FIGS. 1 and 2. A fan 11 is assembled to a top of the radiator 12. When the fan 11 is operated, airflows are produced to flow through the radiator 12 until the supporting frame 13 is reached, so as to produce a cooling effect.

The above-structured supporting frame 13 has the following disadvantages:

1. A highly expensive die-cutting cost is required for manufacturing the conventional supporting frame 13.
2. To assemble the fan 11 and the radiator 12 to the conventional supporting frame 13, more than one additional step is increased in the process of manufacturing the supporting frame 13 to cause inconvenience in the assembling thereof.

3. The fan 11 and the radiator 12 are fixedly assembled to the supporting frame 13, and related parts or components could not be conveniently replaced once the assembling is completed.
4. Since the fan 11 is fixed to a top of the radiator 12, it is necessary to provide a recess 121 on the radiator 12 for leading a wire 111 of the fan 11 to an outer side of the radiator 12.
5. As can be seen from FIG. 3, the main body 131 of the supporting frame 13 is located below the radiator 12, and airflows produced by the fan 11 and downward sent to the radiator 12 tend to produce a backpressure at the supporting frame 13 to largely reduce the heat radiating effect of the radiator 12.

It is therefore tried by the inventor to develop an improved supporting frame with locating function to eliminate the drawbacks existed in the conventional supporting frame used above a CPU.

SUMMARY OF THE INVENTION

A primary object of the present invention is to provide a supporting frame that can be conveniently assembled.

Another object the present invention is to provide a supporting frame that can be manufactured at reduced cost.

A further object the present invention is to provide a supporting frame that can be quickly located in place.

A still further object the present invention is to provide a supporting frame that eliminates the production of backpressure of airflows.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 4:
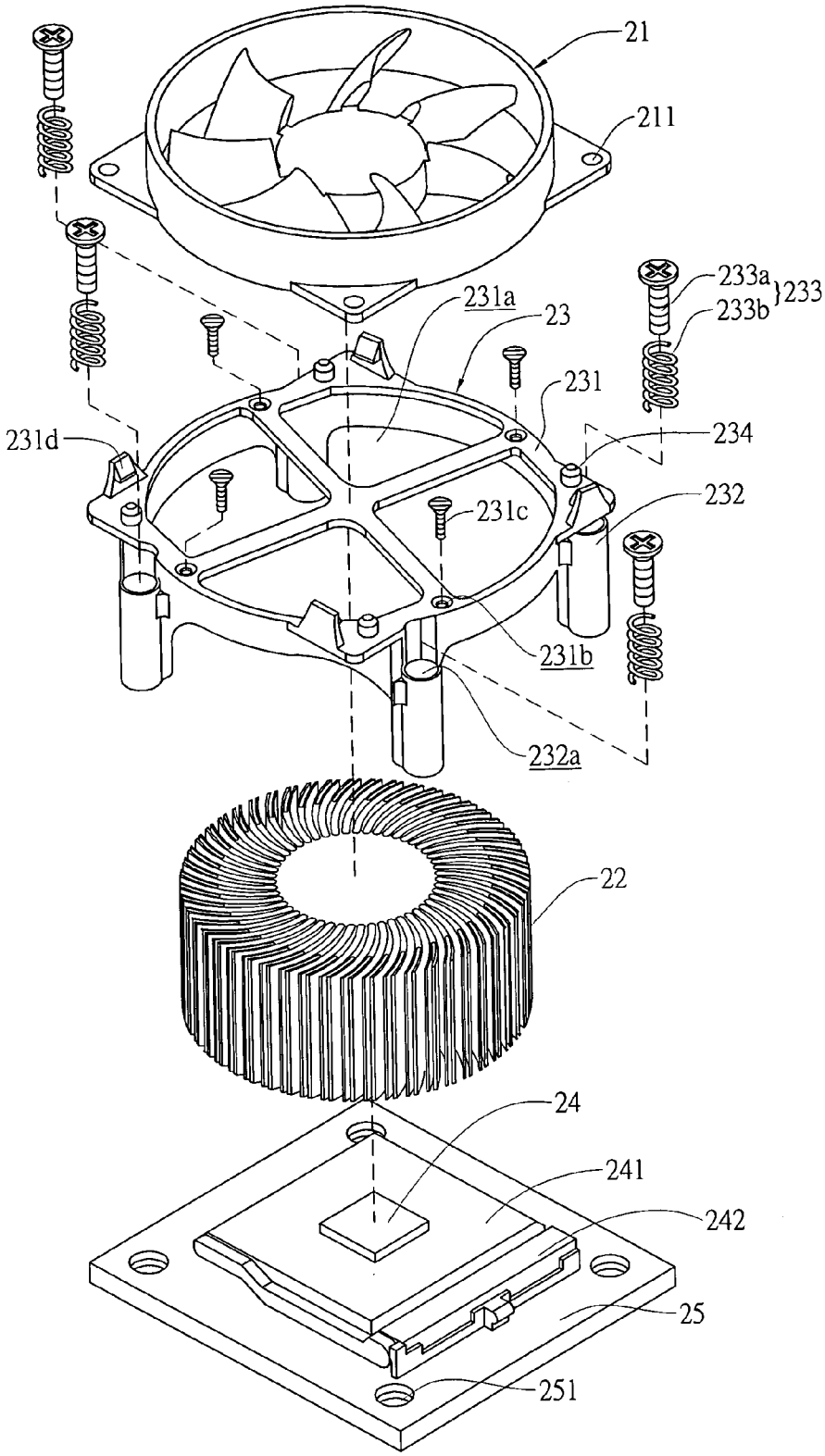
FIG. 4 is an exploded perspective view of a supporting frame according to a first preferred embodiment of the present invention.
Figure 5:
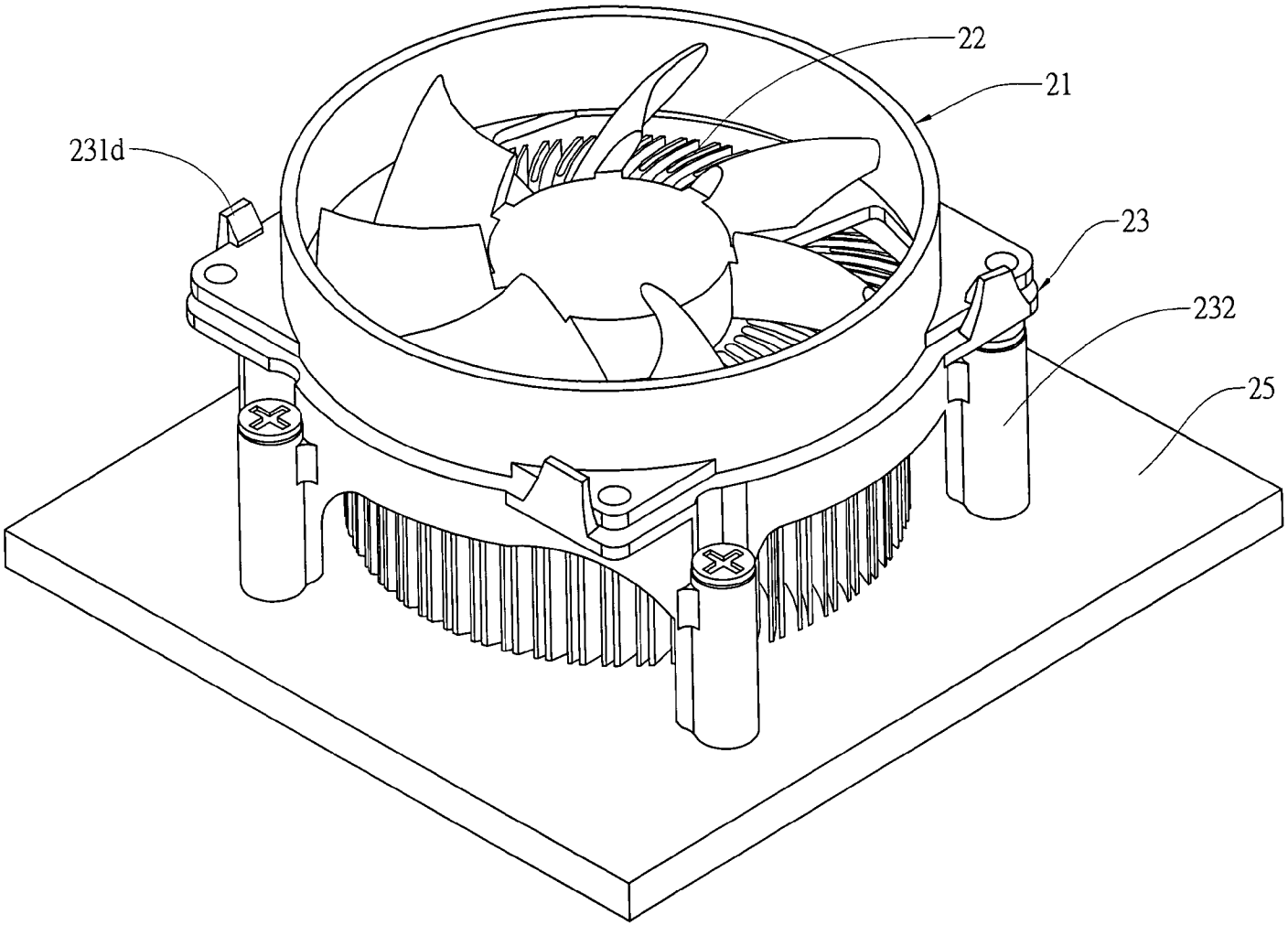
FIG. 5 is an assembled perspective view of FIG. 4.

Please refer to FIGS. 4 and 5 in which a supporting frame with locating function according to a first preferred embodiment of the present invention is shown. As shown, the supporting frame in the first embodiment is generally denoted with a reference numeral 23 and substantially in the form of an annular ring for use over a round-shaped radiator 22. The supporting frame 23 mainly includes a supporting portion 231 and a plurality of connecting portions 232. The supporting portion 231 is provided at a central area with a plurality of hollow spaces 231*a*, at a rim area with spaced and upward extended locating rods 234 for engaging with receiving holes 211 formed on a fan 21, which is to be located above the supporting frame 23, and also at the rim area with spaced fixing holes 231*b*, through which fastening elements 231*c* are extended to thereby connect the supporting portion 231 to a radiator 22 with a lower side of the supporting portion 231 closely bearing against a top of the radiator 22.

Figure 1:
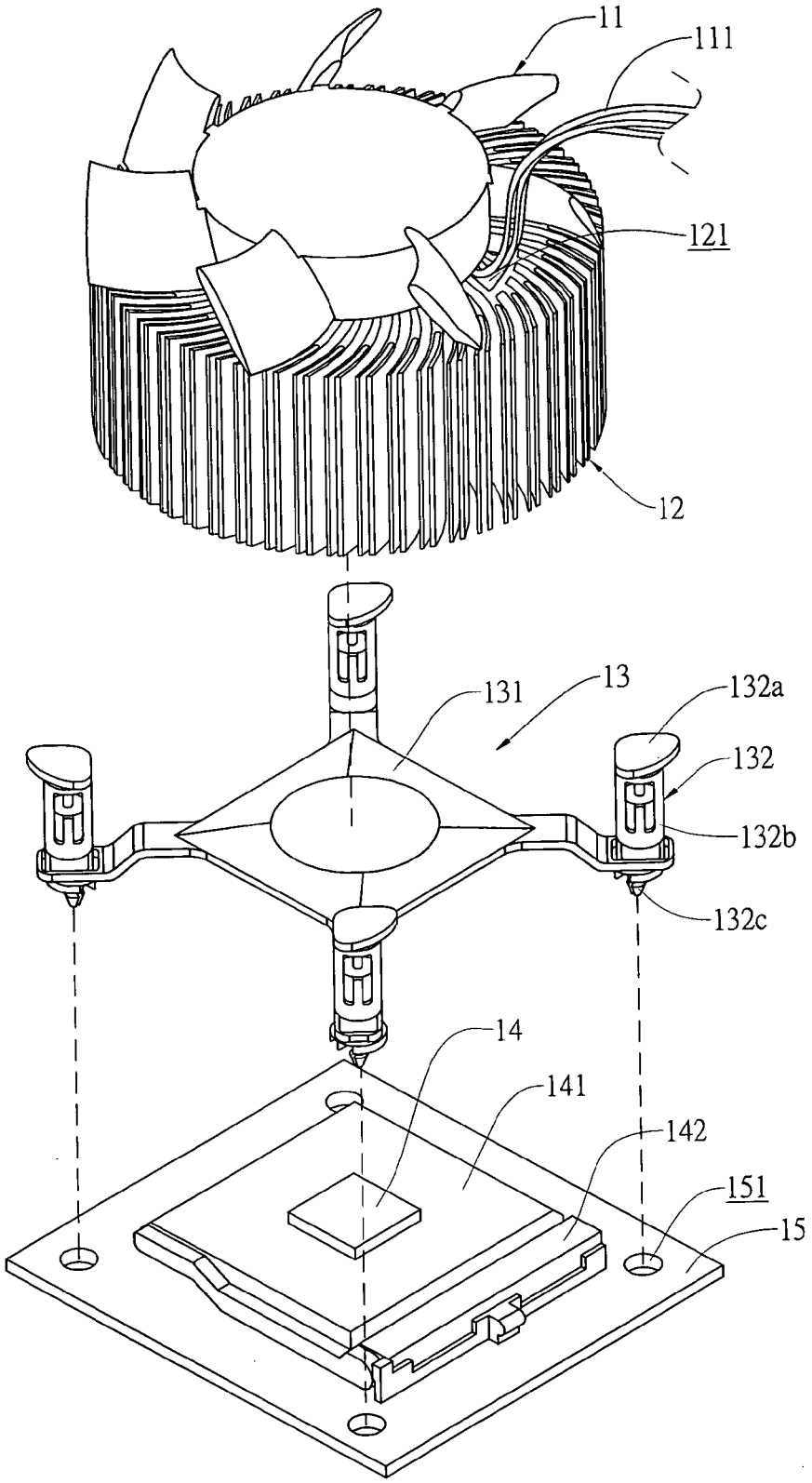
FIG.1 PRIOR ART
FIG. 1 is an exploded perspective view of a conventional supporting frame.
Figure 2:
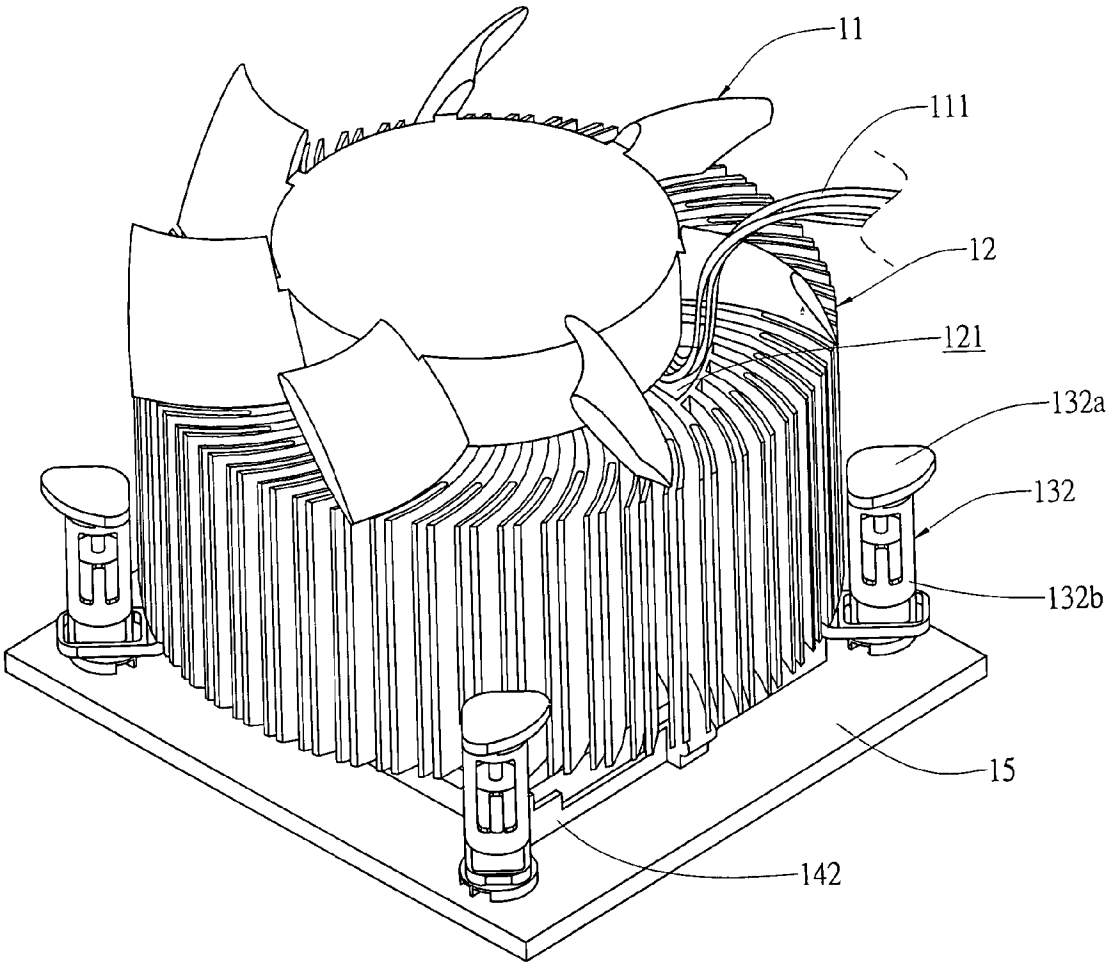
FIG.2 PRIOR ART
FIG. 2 is an assembled perspective view of FIG. 1.
Figure 3:
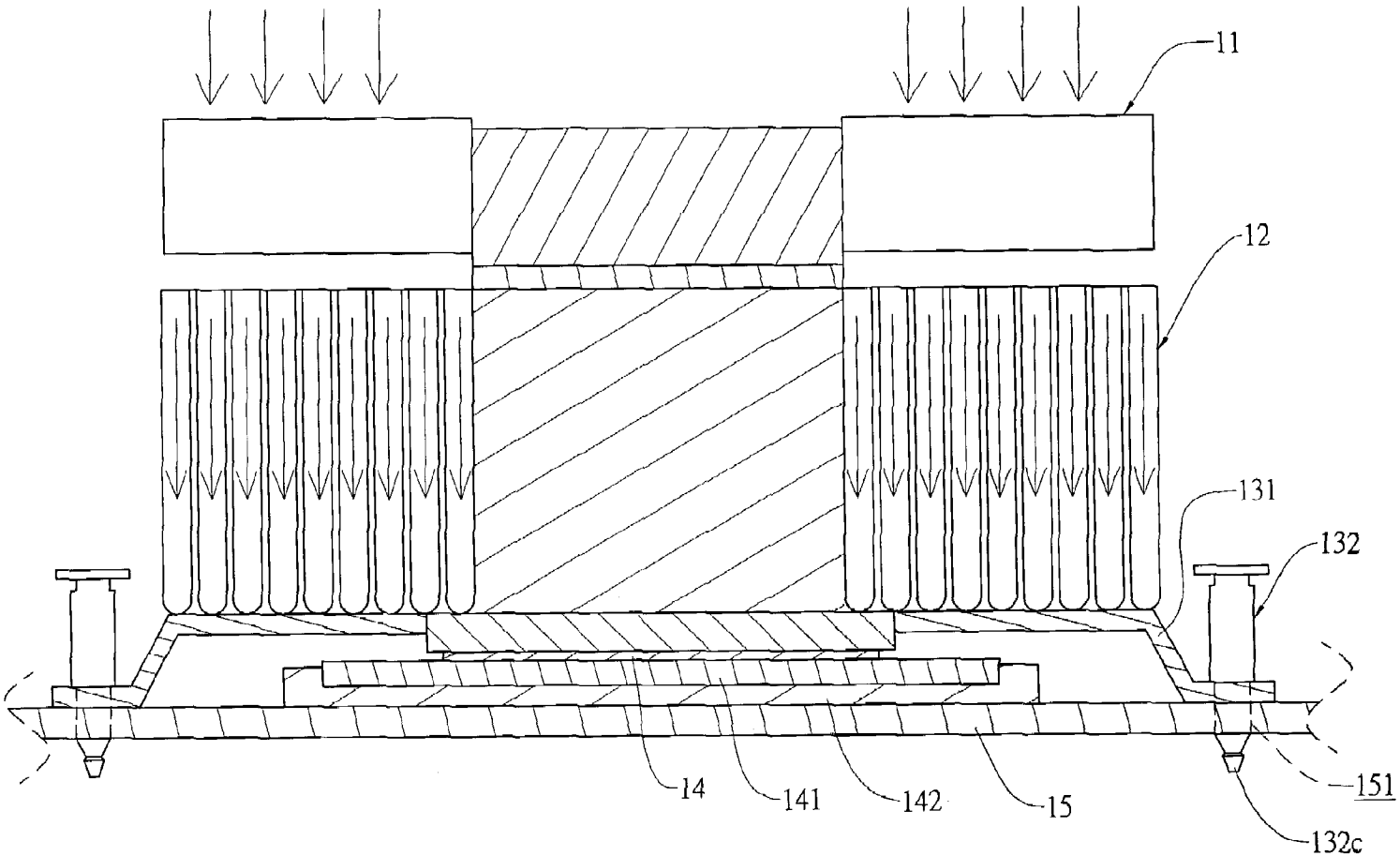
FIG.3 PRIOR ART
FIG. 3 is a sectioned side view of FIG. 2.

Each of the connecting portions 232 is provided with an axially extended connecting hole 232*a*, in which a locating mechanism 233 is received. In the first embodiment of the present invention, the connecting hole 232*a* is a through hole. However, it is understood the connecting hole 232*a* may be otherwise a threaded hole or any other configuration adapted to work with the locating mechanism 233. The locating mechanism 233 includes a locating element 233*a* and an elastic element 233*b*. It is understood the locating mechanism may also be implemented in other manners, such as the locating mechanism 132 for the conventional supporting frame 13 illustrated in FIGS. 1 to 3 to include a driving element 132*a*, and a driven element 132*b*. The connecting portions 232 are connected at an upper side with the supporting portion 231, and at a lower side with a main board 25 via the locating mechanism 233. To assemble the connecting portions 232 to the main board 25, simply extend each locating element 233*a* through the elastic element 233*b* to engage with a receiving hole 251 provided on the main board 25 in the vicinity of a CPU holder 242. At this point, the radiator 22 located below the supporting portion 231 is in contact with a CPU 24 on an operating chip 241 held by the CPU holder 242. Therefore, the supporting frame 23 of the present invention enables quick locating and convenient assembling of the fan 21 and the radiator 22 to the main board 25 and above the CPU 24.

The supporting portion 231 is also provided at a predetermined position with at least one retaining element 231*d*, against which the fan 21 may be pushed to engage therewith, so that the fan 21 is connected to the supporting frame 23 and protected against undesired vibration.

Figure 6:
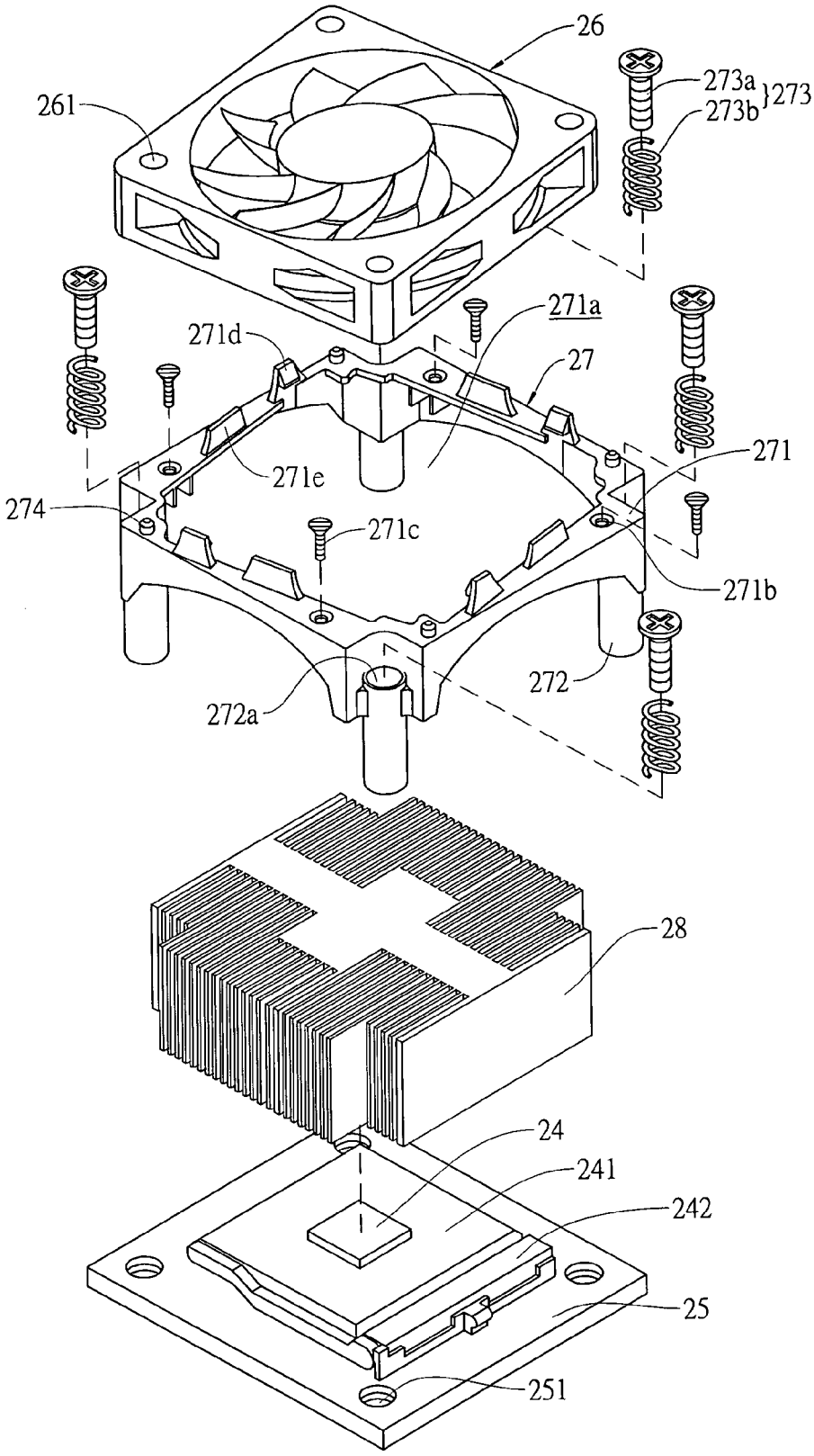
FIG. 6 is an exploded perspective view of a supporting frame according to a second preferred embodiment of the present invention.
Figure 7:
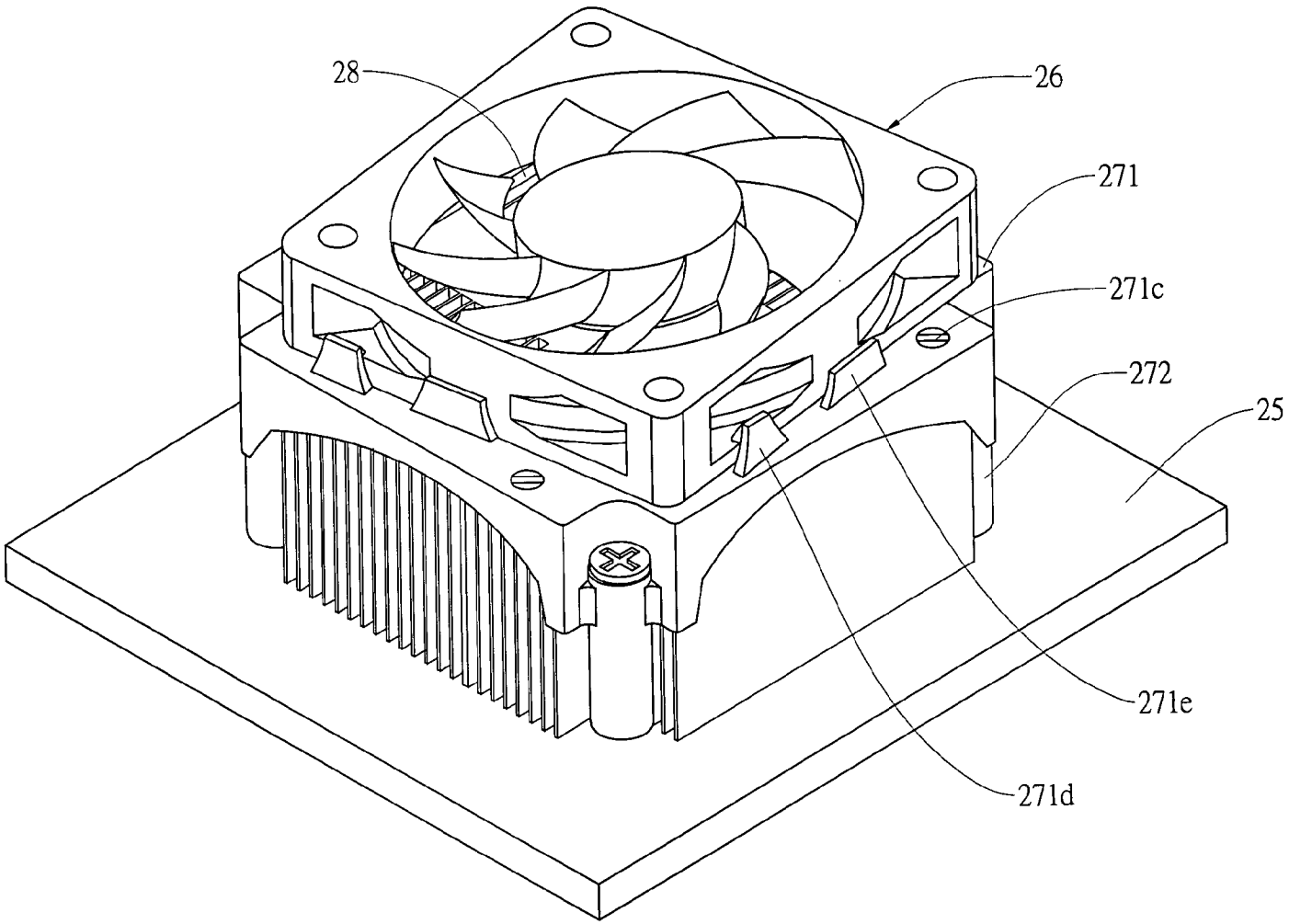
FIG. 7 is an assembled perspective view of FIG. 6.

Please refer to FIGS. 6 and 7 in which a supporting frame with locating function according to a second preferred embodiment of the present invention is shown. As shown, the supporting frame in the second embodiment is generally denoted with a reference numeral 27 and substantially in the form of a polygonal support for use over a polygonal radiator 28. The supporting frame 27 mainly includes a supporting portion 271 and a plurality of connecting portions 272. The supporting portion 271 is provided at a central area with a plurality of hollow spaces 271*a*, at a rim area with spaced and upward extended locating rods 274 for engaging with receiving holes 261 formed on a fan 26, which is to be located above the supporting frame 27, and also at the rim area with spaced fixing holes 271*b*, through which fastening elements 271*c* are extended to thereby connect the supporting portion 271 to a radiator 28 with a lower side of the supporting portion 271 closely bearing against a top of the radiator 28.

Each of the connecting portions 272 is provided with an axially extended connecting hole 272*a*, in which a locating mechanism 273 is received. In the second embodiment of the present invention, the connecting hole 272*a* is a through hole. However, it is understood the connecting hole 272*a* may be otherwise a threaded hole or any other configuration adapted to work with the locating mechanism 273. The locating mechanism 273 includes a locating element 273*a* and an elastic element 273*b*. It is understood the locating mechanism may also be implemented in other manners, such as the locating mechanism 132 for the conventional supporting frame 13 illustrated in FIGS. 1 to 3 to include a driving element 132*a*, and a driven element 132*b*. The connecting portions 272 are connected at an upper side with the supporting portion 271, and at a lower side with a main board 25 via the locating mechanism 273. To assemble the connecting portions 272 to the main board 25, simply extend each locating element 273*a* through the elastic element 273*b* to engage with a receiving hole 251 provided on the main board 25 in the vicinity of a CPU holder 242. At this point, the radiator 28 located below the supporting portion 271 is in contact with a CPU 24 on an operating chip 241 held by the CPU holder 242. Therefore, the supporting frame 27 of the present invention enables quick locating and convenient assembling of the fan 21 and the radiator 22 to the main board 25 and above the CPU 24.

The supporting portion 271 is also provided at a predetermined position with at least one retaining element 271*d*, against which the fan 26 may be pushed to engage therewith, so that the fan 26 is connected to the supporting frame 27 and protected against undesired vibration. The supporting portion 271 may also be provided with at least one locating plate 271*e*, which is engaged with the fan 26 when the latter is pushed against the supporting portion 217. With the locating plate 271*e*, the fan 26 is firmly located above the supporting frame 27 and protected against undesired vibration.

Figure 8:
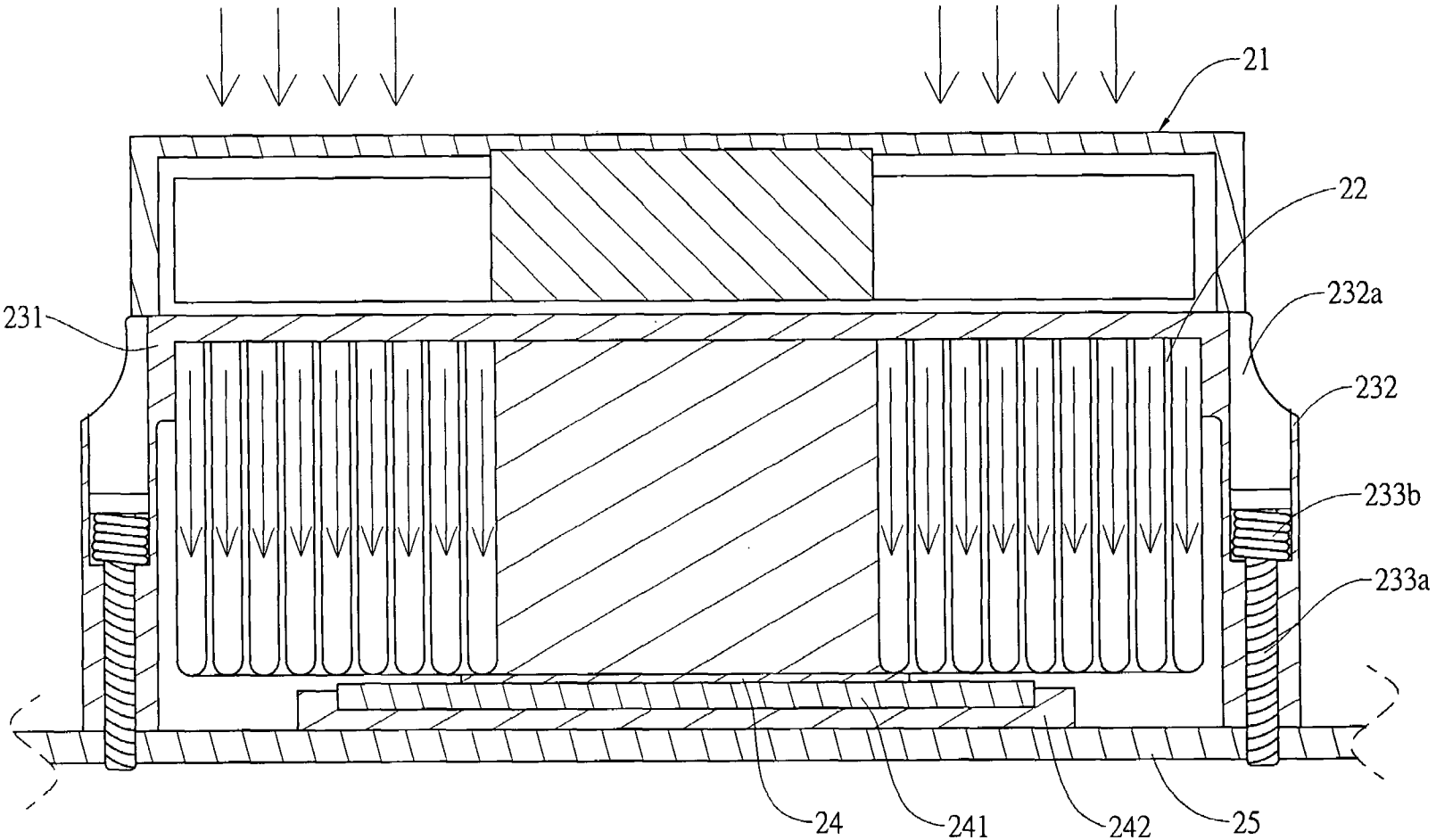
FIG. 8 is an assembled sectioned side view of FIG. 5.
Figure 9:
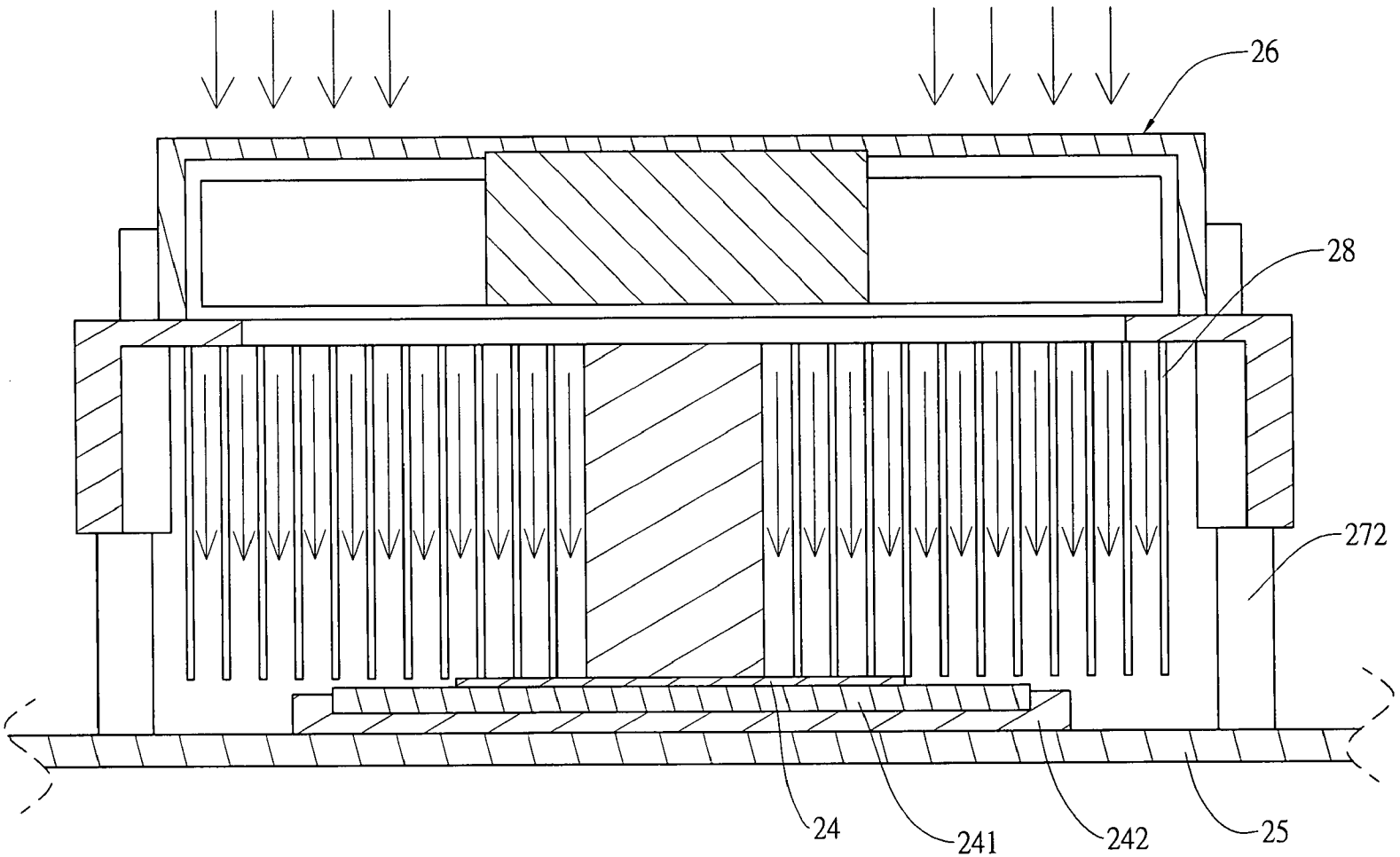
FIG. 9 is an assembled sectioned side view of FIG. 7.

FIGS. 8 and 9 are respectively sectioned side views of the first and the second preferred embodiment of the present invention. As can be seen from FIGS. 8 and 9, the radiators 22, 28 have a bottom that is clear of anything. Airflows produced by the fans 21, 26 are directly sent to the CPU 24, the operating chip 241, the CPU holder 242, and the main board 25 via the radiators 22, 28 and then discharged. The present invention is obviously superior to the conventional supporting frame in terms of the improved heat radiating effect attributable to the present invention.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A supporting frame with locating function, comprising:

a supporting portion, and a plurality of axially extended connecting portions;

said supporting portion being a top side and a bottom side, and being provided at a central area with a plurality of hollow spaces, the top side being connected to a fan and the bottom side being connected to a radiator; and said connecting portions being connected at an upper side to said supporting portion and at a lower side to a main board, the connecting portions being perpendicular to the supporting portion.

2. The supporting frame with locating function as claimed in claim 1, wherein said supporting portion is provided with at least one retaining element, against which said fan is pushed to engage therewith and thereby connected to said supporting portion and protected against undesired vibration.

3. The supporting frame with locating function as claimed in claim 1, wherein said supporting portion is provided with at least one locating plate, against which said fan is pushed to engage therewith and thereby located in place and protected against undesired vibration.

4. The supporting frame with locating function as claimed in claim 1, wherein the bottom of the radiator is substantially planar and free from contact with the support frame.

5. The supporting frame with locating function as claimed in claim 1, wherein the supporting frame between the connecting portions is substantially open.

* * * * *